US005920961A

United States Patent [19]

Hollingsworth

[11] Patent Number: 5,920,961

[45] Date of Patent: Jul. 13, 1999

[54] VENTILATING CARDING ROLL

[75] Inventor: John D. Hollingsworth, Greenville, S.C.

[73] Assignee: John D. Hollingsworth On Wheels, Inc., Greenville, S.C.

[21] Appl. No.: 08/967,004

[22] Filed: Nov. 10, 1997

[51] Int. Cl.[6] ..... D01B 3/04; D01G 15/00; F28D 11/02; F28F 5/02

[52] U.S. Cl. ..... 19/100; 19/65 R; 19/98; 19/99; 19/112; 165/89; 492/46

[58] Field of Search ..... 19/65 CR, 98, 19/99, 100, 112; 165/89, 119, 121, 156; 492/46, 57

[56] References Cited

U.S. PATENT DOCUMENTS

| | | | |
|---|---|---|---|
| 181,744 | 8/1876 | Titus . | |
| 1,174,357 | 3/1916 | Scherer . | |
| 1,203,010 | 10/1916 | Kilberry . | |
| 1,385,396 | 7/1921 | Rayburn . | |
| 1,837,562 | 12/1931 | Mayer . | |
| 1,925,702 | 9/1933 | Nelson . | |
| 2,339,557 | 1/1944 | Runals | 34/115 |
| 3,653,094 | 4/1972 | Fairfield . | |
| 4,245,444 | 1/1981 | Hicks . | |
| 4,443,689 | 4/1984 | Muller et al. | 165/89 |
| 4,499,632 | 2/1985 | Varga | 19/98 |
| 4,869,060 | 9/1989 | Stewart et al. | 57/301 |
| 5,127,134 | 7/1992 | Demuth et al. | 19/102 |
| 5,208,955 | 5/1993 | Schiel | 492/12 |
| 5,212,528 | 5/1993 | Matsuda | 165/89 |
| 5,318,497 | 6/1994 | Aarnink et al. | 492/30 |
| 5,425,158 | 6/1995 | Ripley | 19/98 |

*Primary Examiner*—John J. Calvert
*Assistant Examiner*—Gary L. Welch
*Attorney, Agent, or Firm*—Leatherwood Walker Todd & Mann, P.C.

[57] ABSTRACT

A ventilated carding cylinder for allowing heat generated in the carding cylinder during operation to be dissipated. The carding cylinder includes an internal, longitudinally extending, air flow passage and impeller means provided therein for moving air through the air flow passage during operation of the carding cylinder. This movement of air aids in dissipating heat generated by the carding cylinder during the fiber carding process. Reduction of heat in the carding cylinder can minimize the risk of fire occurring in the fibers and also thermal growth of the cylinder during operation.

14 Claims, 2 Drawing Sheets

VENTILATING CARDING ROLL

BACKGROUND OF THE INVENTION

This invention relates generally to a carding roll for use in a textile fiber processing machine, such as fiber carding machines, fiber cleaning machines, fiber recycling machines, etc.

Textile processing machinery, such as carding machines, cleaning machines, fiber and fabric recycling machines, and the like, process fibers by aligning and cleaning fibers fed into the machine. Rotating carding rolls clothed with carding wire are typically used for engaging and aligning the fibers and for carrying the fibers through carding interfaces, generally created between the carding rolls and cooperating carding segments, flats, or plates, to the output portion of the machine.

The working of the fibers in this manner creates friction which generates heat which is undesirable in that it can increase the risk of fire occurring in fibers being processed, and also, because of the thermal growth experienced by the carding elements, such as carding rolls, during operation. This thermal growth must be compensated for in the design of the machinery to insure that tolerances and clearances are maintained during operation. For example, if the carding interface between a rotating carding roll and a stationary carding element, such as a carding plate or segment, becomes too great, then carding efficiency is reduced. However, if the clearances between those elements are too small, then the machine could potentially malfunction if he carding roll actually engaged a cooperating carding surface, such as a carding flat, segment, or plate.

Thus, it would be desirable to reduce the heat generated in a textile processing machine used for carding, cleaning, or recycling textile fiber or products.

Patented devices include U.S. Pat. No. 5,127,134, issued to Demuth, et al., which discloses removing heat from flats and covering segments by passing liquid or gas through ducts formed in the covering segments and/or between adjacent flats. U.S. Pat. No. 4,499,632, issued to Varga, disclosed the use of fluid in channels provided within the cylinder. U.S. Pat. No. 5,318,497, issued to Aarnick, et al., discloses a roll assembly having wedge-shaped projections for creating turbulence adjacent the end of the roll for forcing dust away from the roll. U.S. Pat. No. 4,869,060, issued to Stewart, discloses a fiber opening device having an opening roller with a hollow interior and openings, which are provided to remove air and entrained dust and trash from a compartment adjacent to the two-way trash separation zone.

In view of the foregoing, there still exists a need for a relatively simple means for cooling a carding roll.

SUMMARY OF THE INVENTION

It is, therefore, the principal object of this invention to provide a carding roll with improved heat dissipation.

It is another object of the present invention to provide a carding roll which uses air as a cooling medium.

Still another object of the present invention is to provide a ventilated carding roll which allows air to passively move therethrough.

Yet another object of the present invention is to provide a ventilated carding roll having impeller means for forcing cooling air through the carding cylinder.

Generally, the present invention includes a fiber engaging cylinder for use in a textile processing machine. The fiber engaging cylinder includes a cylindrical member having a circumferentially extending fiber engaging surface, and a first end and a second end opposite the first end. The cylindrical member defines an internal air flow passage extending the length of the cylindrical member for allowing air to pass therethrough. Further, at least one impeller is provided in the air flow passage for propelling air from the first end of the cylindrical member to its second end.

More specifically, the impeller could be one of a variety of different designs and could include one or more propellers disposed within the carding cylinder substantially coaxial with the axis of rotation of the carding cylinder.

DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
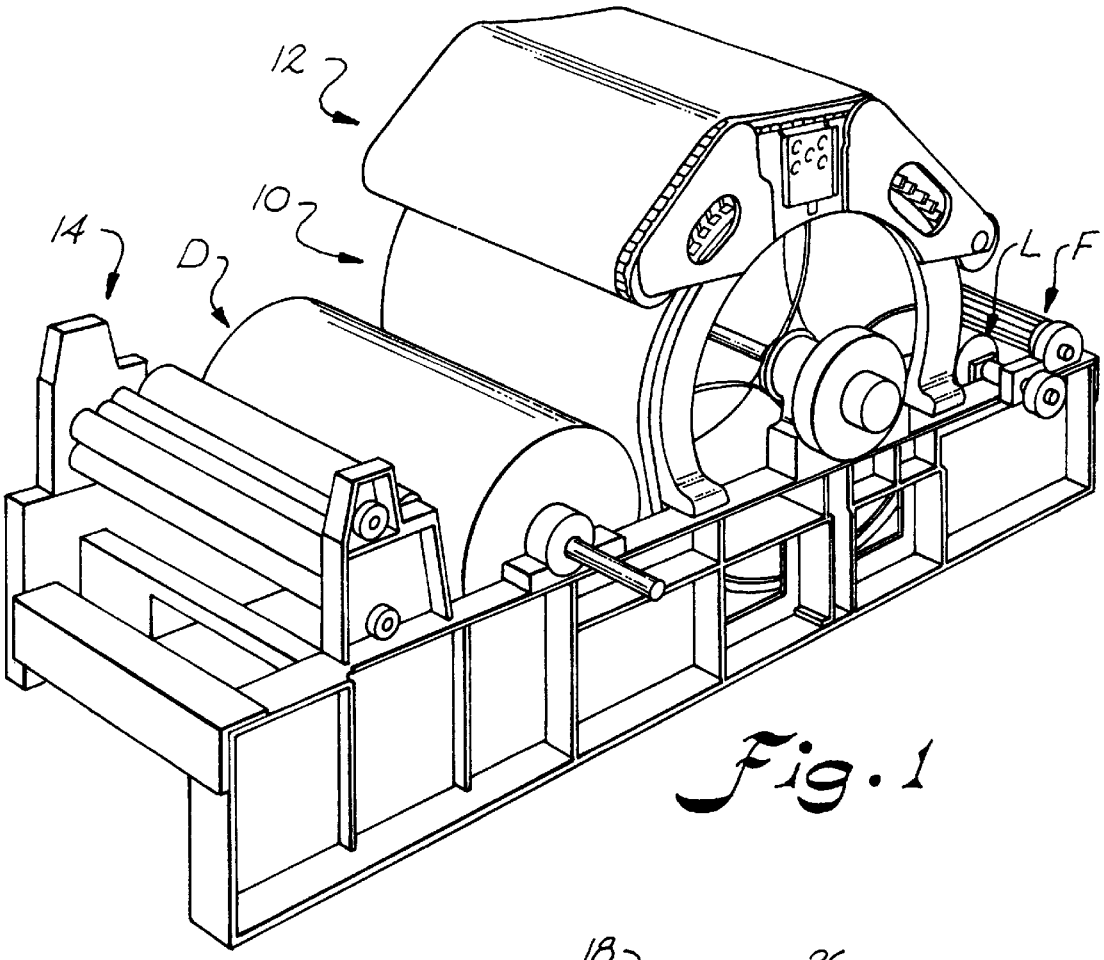
FIG. 1 is a perspective view of a textile carding machine having a ventilated carding cylinder constructed in accordance with the present invention.

The accompanying drawings and the description which follows set forth this invention in its preferred embodiment. However, it is contemplated that persons generally familiar with textile machinery will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the ventilated carding roll of the present invention is indicated generally in the figures by reference character 10.

Turning to FIG. 1, a carding machine having a ventilated carding roll constructed in accordance with the present invention is shown. The carding machine includes an input portion wherein fibers are input into a feed roll F. From the feed roll F, the fibers pass to a lickerin roll L and then are picked up by the ventilated carding cylinder 10 of the present invention. Carding cylinder 10 carries the fibers about its periphery during the carding operation, wherein fibers (not shown) are carded and cleaned. Carding interfaces are formed about the carding cylinder in a conventional manner, and include a series of revolving flats, generally 12, positioned above cylinder 10. The flats include a series of elongated bars having wire clothing thereon for cooperating with the wire clothing (not shown) on cylinder 10. Downstream of cylinder 10 is a doffer roll D which removes or "doffs" the fibers from the carding cylinder. Typically, in a carding machine, the fibers are removed in the form of a batt or web (not shown). This web is subsequently removed from the doffer by a web removal system, generally 14, which could be of conventional design.

Figure 2:
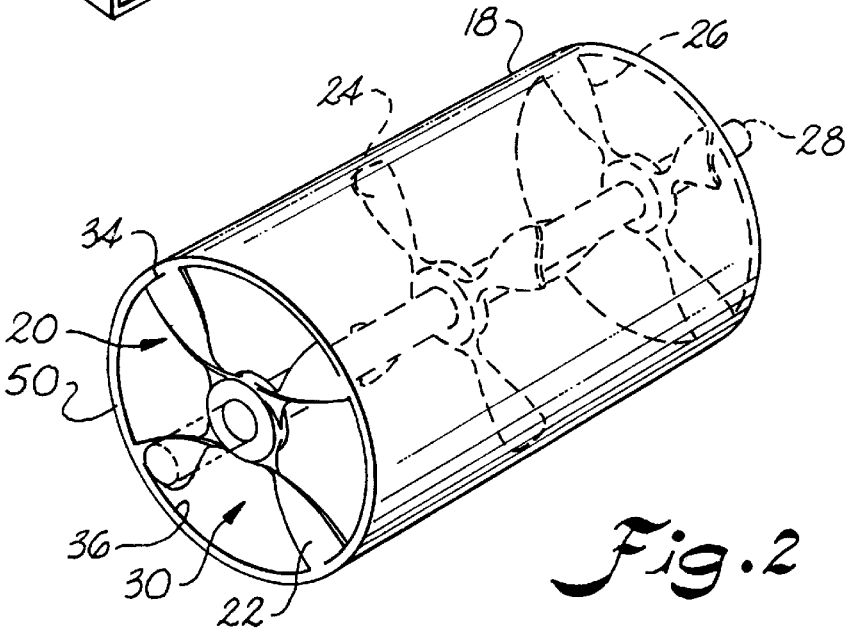
FIG. 2 is a perspective view of a ventilated carding cylinder constructed in accordance with the present invention.

FIG. 2 illustrates a preferred embodiment of a carding cylinder 10. In this embodiment, carding cylinder 10 includes a cylindrical outer surface 18 to which metallic clothing, such as carding wire, is attached. The inner portion of cylinder 10 is generally open along its length, except for a series of impellers, generally 20. In the embodiment illustrated in FIG. 2, the impellers are in the form of propellers 22, 24, 26. These propellers are coaxially aligned with one another about axle 28. Impellers 22, 24, 26 also act as structural supports and spacers for holding axle 28 concentrically within cylinder 18.

Cylinder 18, by being open along its length, defines an internal air passage, generally 30, extending the length of cylinder 10.

In the FIG. 2 embodiment, propellers 22, 24, 26 are disposed within air passage 30 and serve, upon rotation of cylinder 10, to pull air in one end of cylinder 10 and expel it out the other end of cylinder 10. This causes an air flow through air passage 30 during operation of cylinder 10 within a carding machine, or other textile processing machine. It is to be understood that while cylinder 10 thus far has been explained in the context of a carding machine, it can be used in other textile machines, such as a fiber cleaning machine, fiber recycling machine, and the like, the general teachings herein being directed toward cooling a rotating textile processing member by providing air passages and impellers in central portions thereof.

As shown in FIG. 2, the extreme ends, or tips, 34, of propellers 22, 24, 26, are preferably attached to the inner surface 36 of cylinder 10 by welding, fasteners such as rivets, bolts, screws or the like, or any other suitable means. This causes propellers 22, 24, 26 to serve a dual to purpose in both directing air flow through air passage 30 during operation, and also for being structural members to concentrically support cylinder 10 about axle 28. This support includes supporting the carding surface of roll 10 both with respect to compression and tension forces, and stresses such as hoop stress which can occur during operation.

Figure 3:
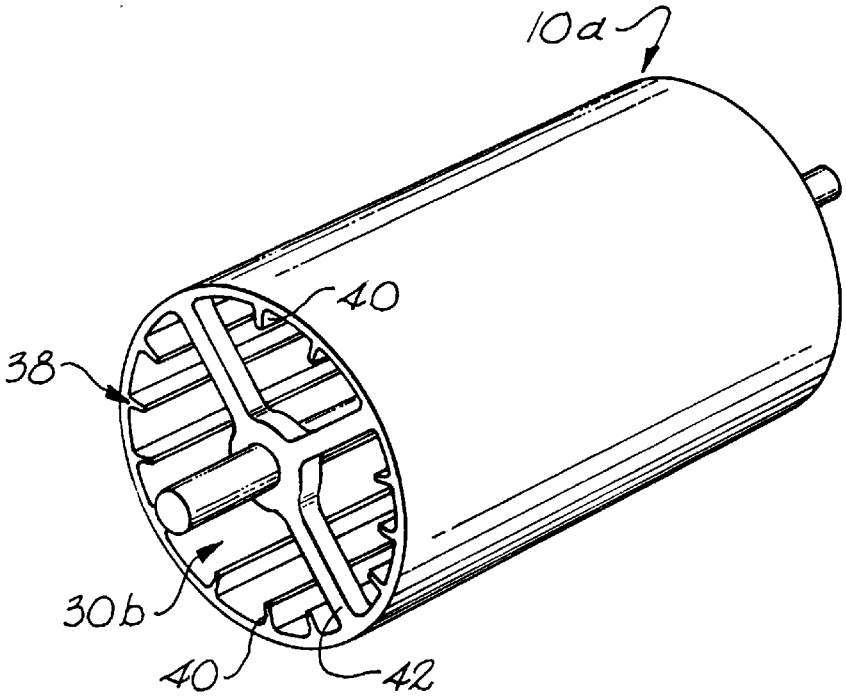
FIG. 3 is a perspective view of an alternate embodiment of a ventilated carding cylinder constructed in accordance with the present invention.

FIG. 3 is an alternate embodiment carding roll 10*a* constructed in accordance with the present invention. Instead of using impellers in the form of propellers, such as discussed above, a squirrel cage-type blower impeller, generally 38, is constructed using fins 40 which can extend substantially the length of air passage 30*b*. These impellers can extend longitudinally, or can be spiraled, or inclined with a predetermined twist (not shown) in order to funnel and propel air through air passage 30*b* during operation.

Fins 40, while capable of being configured to push air through air passage 30*b*, also act as heat sinks for directing heat away from the carding surface of cylinder 10*a* towards air passage 30*f*, where the heat can thus be more readily dissipated.

Axle 28 is concentrically supported within carding cylinder 10*a* by end supports or spiders 42 (only one shown).

Figure 4:
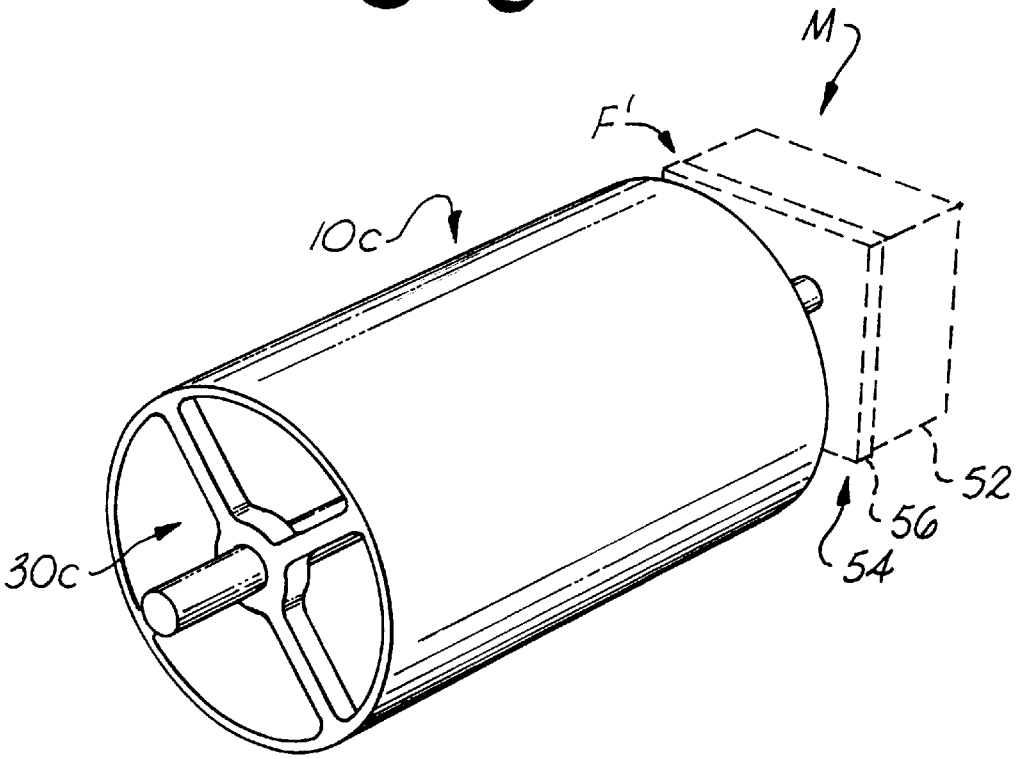
FIG. 4 is a perspective view of a further alternate embodiment of a ventilated carding cylinder constructed in accordance with the present invention.

Turning to FIG. 4, a further alternate embodiment of the present invention is shown. Carding cylinder 10*c* includes air passage 30*c*, but otherwise has no specific impeller means. Air is allowed to simply passively move through air passage 30*c* during operation, or, external fans can be provided (not shown) for blowing air through the air passage 30*c*.

Although the primary purpose of the present invention is to provide increased cooling of the carding surface carried on a carding roll by providing a simple, efficient air flow through the carding cylinder, a side benefit could be had. This side benefit potentially involves the additional removal of dust and debris from the fibers in that the suction formed in the intake end 50 of a carding cylinder, such as illustrated in FIG. 2, could, in addition to sucking air in, also suck in dirt and debris. This dirt and debris could be collected by filters at the exhaust end of the air passage, and disposed of, thereby reducing the contamination and ambient environment.

Alternately, as shown in FIG. 4, external air flow means, generally M, such as a blower 52 can be provided for blowing air through the air passages 30, 30*a*, 30*b*, 30*c* to enhance the flow rate and quantity of air passing therethrough. Blower 52 can be of conventional design and could be placed adjacent an end of an air passage for propelling air therethrough (through suction or through blowing air), or could be placed at a distance from the air passage and ducted thereto. If blower 52 is oriented such that its air intake 54 is adjacent an air passage for drawing, instead of blowing, air through the air passage, this could be allow for use of a filtration system, generally F'. The filtration system could include a conventional filter 56 connected to blower 52 for filtering air passing through the air passage. Thus, the suction pulled through the air passage could serve to both capture and constrain micro-dust, fibers, dirt, trash, etc. generated during the fiber carding process, in addition to providing a forced air cooling air flow for the carding roll.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A fiber carding roll for use in a textile processing machine, the fiber carding roll comprising:

a cylindrical member having a circumferentially extending fiber carding surface and a first end and a second end opposite said first end said first and second ends having openings;

said cylindrical member defining an internal air flow passage extending the length of said cylindrical member for allowing air to pass therethrough; and at least one impeller provided in said air flow passage for propelling air from said first end to said second end of said cylindrical member.

2. A device as defined in claim 1, wherein said at least one impeller is a propeller.

3. A device as defined in claim 1, wherein said at least one impeller includes a squirrel-cage type impeller member.

4. A device as defined in claim 1, wherein said at least one impeller includes a first impeller adjacent said first end of said cylindrical member and a second impeller adjacent said second end of said cylindrical member.

5. A device as defined in claim 4, wherein said at least one impeller includes a medial impeller positioned in said air passage between said first and second impellers.

6. A device as defined in claim 1, wherein said at least one impeller includes longitudinally extending heat sinks extending in said air flow passage of said cylindrical member.

7. A device as defined in claim 1, further comprising an axle extending the length of said cylindrical member and said at least one impeller being attached to said axle.

8. A device as defined in claim 2, wherein said cylindrical member has an inner surface adjacent said air flow passage and wherein said impeller is a propeller having at least one blade extending radially outwardly, said blade having an extreme end attached to said inner surface of said cylinder.

9. A device as defined in claim 1, further comprising a blower for blowing air through said air flow passage.

10. A device as defined in claim 1, further comprising a blower for suctioning air through said air flow passage.

11. A device as defined in claim 10, further comprising a filter associated with said blower for filtering dust and debris from said air suctioned through said air flow passage by said blower.

12. A carding cylinder for use in a textile processing machine, the carding cylinder having a circumferentially extending fiber carding surface and defining an internal air flow passage extending substantially the length of said cylinder for allowing air to pass therethrough and a plurality of heat sinks connected to the carding cylinder within said air flow passage and extending a major portion of the length of said air flow passage for dissipating heat generated during operation of the carding cylinder in the textile processing machine.

13. A fiber carding roll for use in a textile processing machine, the fiber carding roll comprising:

a cylindrical member having a circumferentially extending fiber carding surface and a first end and a second end opposite said first end said first and second end having openings;

said cylindrical member defining an internal air flow passage extending the length of said cylindrical member for allowing air to pass therethrough; and a blower for propelling air from said first end to said second end of said cylindrical member.

14. A device as defined in claim 13, further comprising a filter associated with said blower for filtering dust and debris from said air propelled through said air flow passage by said blower.

* * * * *